US007025693B2

(12) United States Patent
Sugimoto

(10) Patent No.: US 7,025,693 B2
(45) Date of Patent: Apr. 11, 2006

(54) GOLF CLUB HEAD

(75) Inventor: Yasushi Sugimoto, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/318,074

(22) Filed: Dec. 13, 2002

(65) Prior Publication Data

US 2003/0139227 A1 Jul. 24, 2003

(30) Foreign Application Priority Data

Dec. 14, 2001 (JP) ..... 2001-382062
Jul. 2, 2002 (JP) ..... 2002-193802

(51) Int. Cl.
*A63B 53/04* (2006.01)

(52) U.S. Cl. ..... 473/342; 473/349; 473/350

(58) Field of Classification Search ..... 473/324, 473/329, 332, 342, 345, 346, 349, 350, 409, 473/290, 291
See application file for complete search history.

(56) References Cited

U.S. PATENT DOCUMENTS 4,214,754 A * 7/1980 Zebelean ..... 473/346
4,252,262 A * 2/1981 Igarashi ..... 228/174
4,398,965 A * 8/1983 Campau ..... 148/522
4,438,931 A * 3/1984 Motomiya ..... 473/346
5,261,663 A * 11/1993 Anderson ..... 473/342
5,261,664 A * 11/1993 Anderson ..... 473/342
5,282,624 A * 2/1994 Viste ..... 473/342
5,527,034 A * 6/1996 Ashcraft et al. ..... 473/330
5,720,673 A * 2/1998 Anderson ..... 473/342
5,743,813 A * 4/1998 Chen et al. ..... 473/329
5,766,094 A * 6/1998 Mahaffey et al. ..... 473/342
5,930,887 A * 8/1999 Tomita et al. ..... 29/527.1
6,030,295 A * 2/2000 Takeda ..... 473/345
6,050,904 A * 4/2000 Kuo ..... 473/342
2002/0016218 A1* 2/2002 Takeda ..... 473/324

FOREIGN PATENT DOCUMENTS

JP 6-182006 A 7/1994
JP 10-24131 A 1/1998
JP 10-286332 A 10/1998

OTHER PUBLICATIONS

"Golf Digest", Dennis, Larry, Jan. 1975, "What Irons are best for you-forged or cast?", pp. 40, 41.*

* cited by examiner

*Primary Examiner*—Sebastiano Passaniti
(74) *Attorney, Agent, or Firm*—Birch, Stewart, Kolasch & Birch, LLP

(57) ABSTRACT

A golf club head including a face member forming at least a part of the club face for hitting a golf ball, and a main body to which the face member is attached in the form of a junction, in which the joint surface of the face member and the joint surface of the main body come into contact with each other, and at least one of the joint surface of the face member and the joint surface of the main body is machined using a machine tool such as NC lathe turning machine and NC milling machine.

9 Claims, 12 Drawing Sheets

GOLF CLUB HEAD

BACKGROUND OF THE INVENTION

The present invention relates to a golf club head, more particularly to a coupling structure between a face member and main body of the golf club head.

In recent years, in order to provide golf clubs which are easy to use for average golfers, the club heads are designed to position the gravity point of the club head lower and deeper and to increase the moment of inertia around a vertical axis passing the gravity point.

On the other hand, the recent trend of manufacturing such golf club heads is to form major parts of a head by casting. Even in precision castings, however, in terms of shape and dimensions, the degree of accuracy in the casting process sometimes is lower than acceptable levels. This is especially remarkable at the edges of the cast articles in which edges are usually utilized to connect the parts with each other. Also in the case of forgings which is provided with a reduced thickness part and/or a largely bent part in particular, the degree of accuracy tends to be lower than acceptable levels. Thus, such lowering of accuracy deteriorates not only the dimensions, shape and other important parameters such as loft angle and lie angle but also the strength, durability and the like, of the golf club.

SUMMARY OF THE INVENTION

It is therefore, an object of the present invention to provide a golf club head, in which joint surfaces which contact with each other and form a junction between, e.g., a face member and a main body are finished using a machine tool to eliminate dimensional variations and improve the accuracy of the junction.

According to the present invention, a golf club head comprises a face member forming at least a part of the club face for hitting a golf ball, and a main body to which the face member is attached to form a junction in which the joint surface of the face member and a joint surface of the main body come into contact with each other, wherein at least one of the joint surface of the face member and the joint surface of the main body is machined using a machine tool.

Here, the expression "junction means various joints such as welded joint and caulking joints (press fit joints) where. e.g., the joint surface of the face member and the joint surface of the main body come into contact with each other in a certain contact area or along a line (namely, an almost zero contact area) and the amount of contact determines the relative physical relationship between the face member and the main body.

The "machined" surface means the removal of unwanted substances in unwanted parts of the work, such as for example, fine metal shavings, powder and the like using a machine tool so that the finished surface (P) of the work possesses specific predetermined dimensions and shape.

The "machine tool" means a lathe turning machine, a milling machine and the like. Here, manual type of machine tools may be used, but NC type, namely, numerical control machine tools in which cutware is numerically controlled by a NC program are especially preferably used in view of the productivity.

DESCRIPTION OF THE PREFERRED EMBODIMENTS

Figure 1:
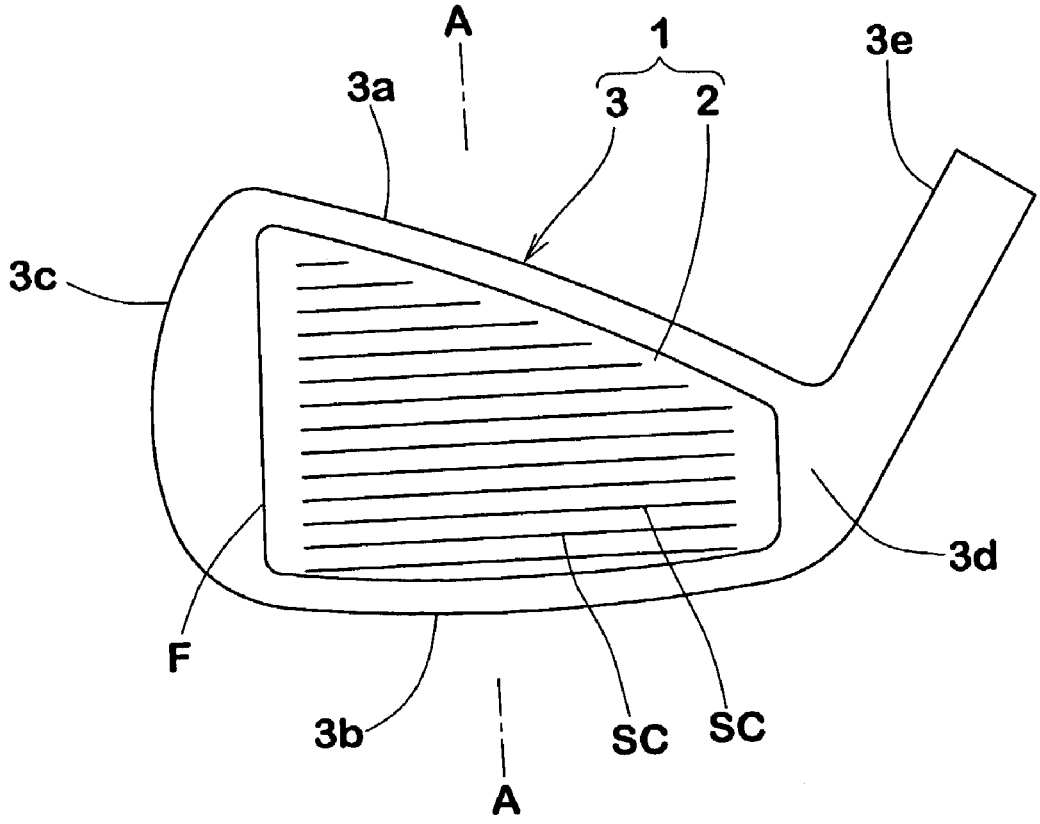
FIG. 1 is a front view of an iron-type club head according to the present invention.

Embodiments of the present invention will now be described in detail in conjunction with the accompanying drawings.

In the drawings, golf club head 1 according to the present invention comprises a face member 2 and a main body 3. The face member 2 is fixed to the main body 3, forming a junction therebetween.

In the following embodiments, the face member 2 forms the entirety of the club face F for hitting a ball. But, it is also possible to design the face member 2 to form a part of the club face F.

At the junction of the face member 2 and main body 3, at least one of the joint surfaces of the face member 2 and the main body 3 is a machined surface (P). In other words, the surface is finished using a machine tool. In the following embodiments, a NC lathe turning machine and/or a NC milling machine are used as the machine tool.

Iron-type Club Head

FIGS. 1, 2, 3 and 4 show an iron-type club head 1 according to the present invention.

The face member 2 in this embodiment is a generally trapezoidal metal plate in which the front face defines the club face F. in order to increase the sweet spot area of the club face, the face member 2 is made of a metal material having a specific gravity of less than the undermentioned metal material of the main body 3. In this example, a titanium alloy is used. The thickness (t) thereof is set in a range of from 1.5 to 4.5 mm, preferably 2.0 to 4.0 mm, more preferably 2.0 to 3.5 mm in view of rebound performance and durability. Aside from titanium alloys, however, various materials such as pure titanium, maraging steel, aluminum alloys and amorphous alloys may be also used.

The face member 2 is a cast article having a front face (F) which is substantially flat, a back face 2*b* which is also substantially flat in this example, and a side face 2*a* extending between the front face (F) and the back face 2*b*. In this example, the side face 2*a* is made up of a protruding face 2*a*1 on the back face side which is substantially perpendicular to the front face (F), a relatively recessed face 2*a*2 on the front face side which is substantially perpendicular to the front face (F), and a linkup face 2*a*3 which extends between the front edge of the protruding face 2*a*1 and the rear edge of the recessed face 2*a*2 and substantially parallel to the front face (F).

Figure 2:
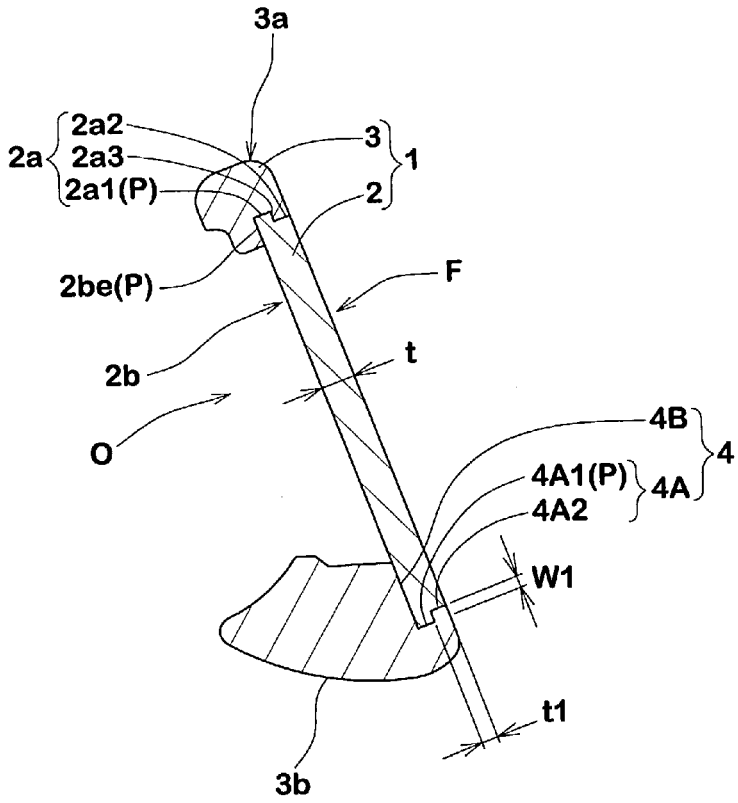
FIG. 2 is a cross sectional view thereof taken along a line A—A in FIG. 1.

Thus, the side face 2*a* displays a zigzag contour in a cross section as in FIG. 2.

The substantially flat front face (F) is provided with small parallel horizontal grooves SC to increase the friction of the club face F against the ball.

Although the recessed face 2*a*2 and linkup face 2*a*3 in this example intersect perpendicularly with each other, they can be formed as a single face tapering from the front edge of the protruding face 2*a*1 to the front face (F).

The main body 3 in this embodiment is made of a metal material having a specific gravity larger than that of the face member 2.

The main body 3 comprises an upper part 3*a* forming the top blade of the club head, a lower part 3*b* forming the sole of the club head, a toe part 3*c* and heel part 3*d* extending therebetween, and a hosel 3*e* extending upwards from the heel part 3*d* and having an opening for receiving a club shaft.

The lower part 3*b* is thick and provided with a large volume backwards extension to render the gravity point of the club head 1 lower and deeper.

The main body 3 in this example is a cast article of a stainless steel formed by lost-wax precision casting. Specifically, a stainless steel SUS630 is used. But, other metal materials such as soft iron, titanium alloy, aluminum alloy and the like may be used aside from stainless steel.

Figure 3:
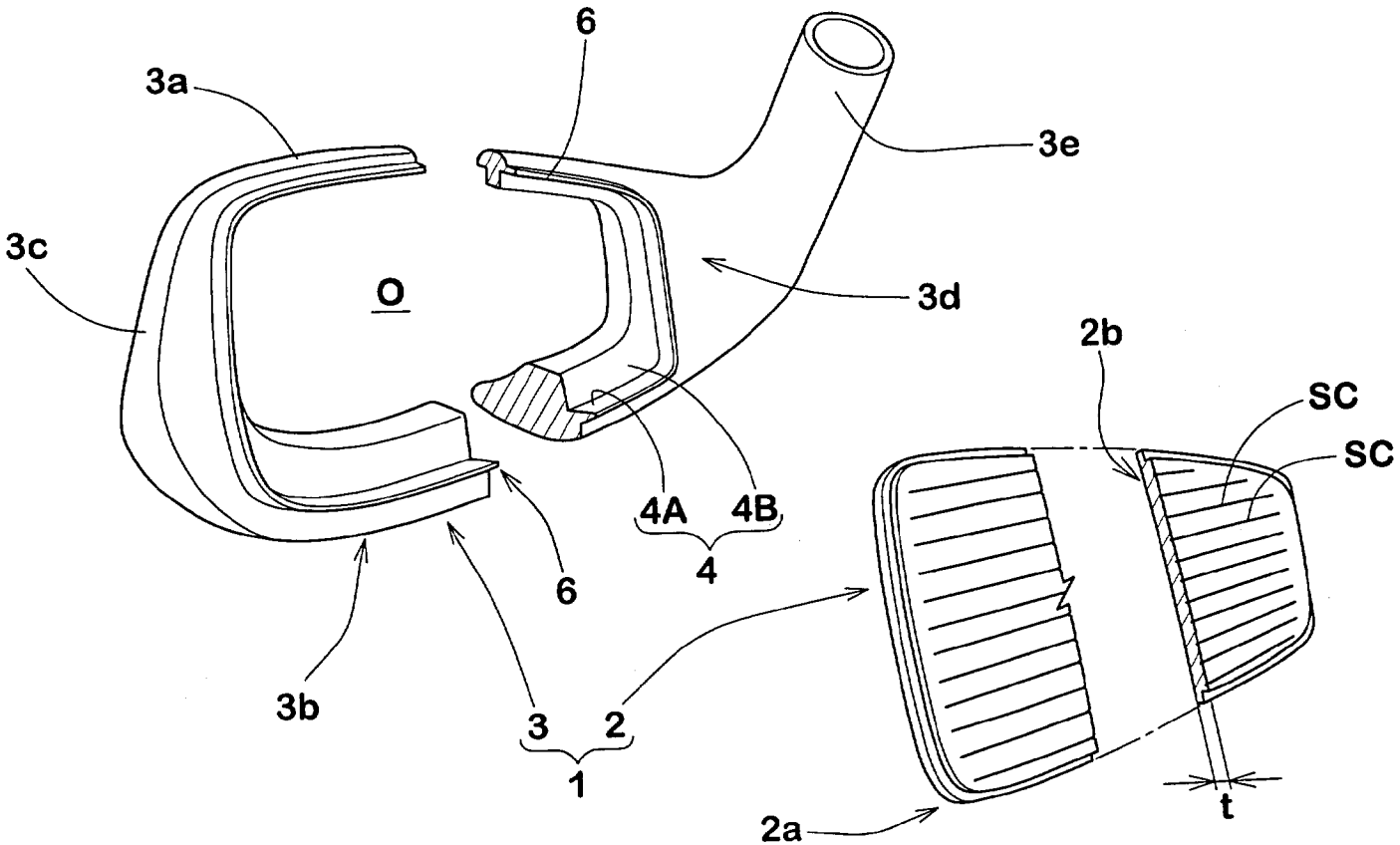
FIG. 3 is an exploded perspective view of the club head showing a face member and a main body, wherein the main body shown is in a state such that the main body has not yet undergone press working for fixing the face member mounted thereon.

The above-mentioned upper part 3*a*, lower part 3*b*, toe part 3*c* and heel part 3*d* continue annularly and form a through hole which defines an opening (O) on the front of the main body 3 as shown in FIG. 3. FIG. 3 shows the main body 3 and face member 2 which are not yet assembled.

The opening (O) forms a face mount 4 to which the face member 2 is attached. The face mount 4 comprises a side-support circumferential wall 4A contacting and supporting the side face 2*a* of the face member 2, and a back-support wall 4B protruding into the opening (O) from the rear end of the wall 4A and contacting and supporting the back face 2*b* of the face member 2.

Figure 4:
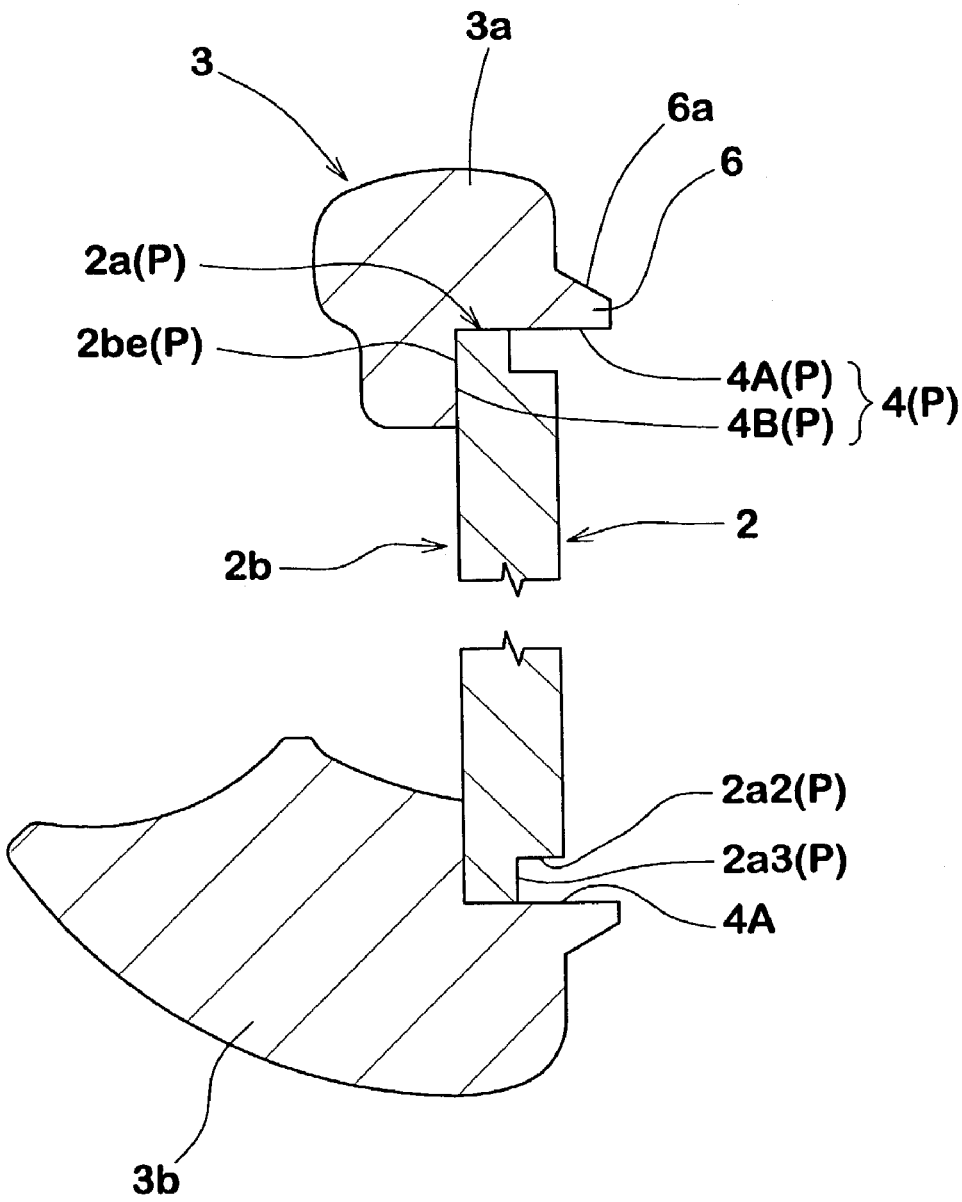
FIG. 4 is an enlarged cross sectional view corresponding to that shown in FIG. 2, wherein the face member is mounted on the main body, but the main body is not yet undergone press working for fixing the face member to the main body.

At first, the main body 3, as shown in FIG. 3 and FIG. 4, is continuously provided along the front edge of the opening (o) with a thin part 6 protruding ahead of the front face of the main body 3. The above-mentioned side-support circumferential wall 4A is extended through this thin part 6 to the front end of the protruding part 6 from a certain depth from the front face of the main body 3 in a perpendicular manner to the front face of the main body 3. On the contrary, the circumferential outside face 6*a* of the protruding part 6 is inclined so that this part 6 tapers towards the front. As a result, the cross sectional shape of the protruding part 6 becomes trapezoidal.

Form the rear end of the side-support circumferential wall 4A at that depth, the above-mentioned back-support wall 4B protrudes to support a peripherally part of the back face 2*b* of the face member 2. As shown in FIG. 3, the wall height is large in the lower part 3*b* but small in the upper part 3*a*. In the toe part 3*c* and heel part 3*d*, the wall height gradually decreases from the lower part 3*b* to the upper part 3*a*.

As shown in FIG. 4, the face member 2 is pushed into the opening (O), and using a pressing machine, the protruding part 6 is squashed into the groove formed by the wall 4A and faces 2*a*2 and 2*a*3 to lock the face member 2 as shown in FIG. 2.

This locking part 4A2 squashed into the groove has a thickness t1 in a range of from 0.3 to 2.0 mm, preferably 0.5 to 1.0 mm, and a height W1 in a range of from 0.3 to 2.0 mm, preferably 0.5 to 1.0 mm. If the thickness t1 is less than 0.3 mm and/or the height w1 is less than 0.3, the locking force becomes insufficient, and there is a tendency for the face member 2 to come off during use. If the thickness t1 is more than 2.0 mm and/or the height W1 is more than 2.0, it becomes difficult to squash without causing damage to the face member 2.

In case the locking part 4A2 is relatively small, it is preferable that an adhesive agent is used at the same time.

Figure 5:
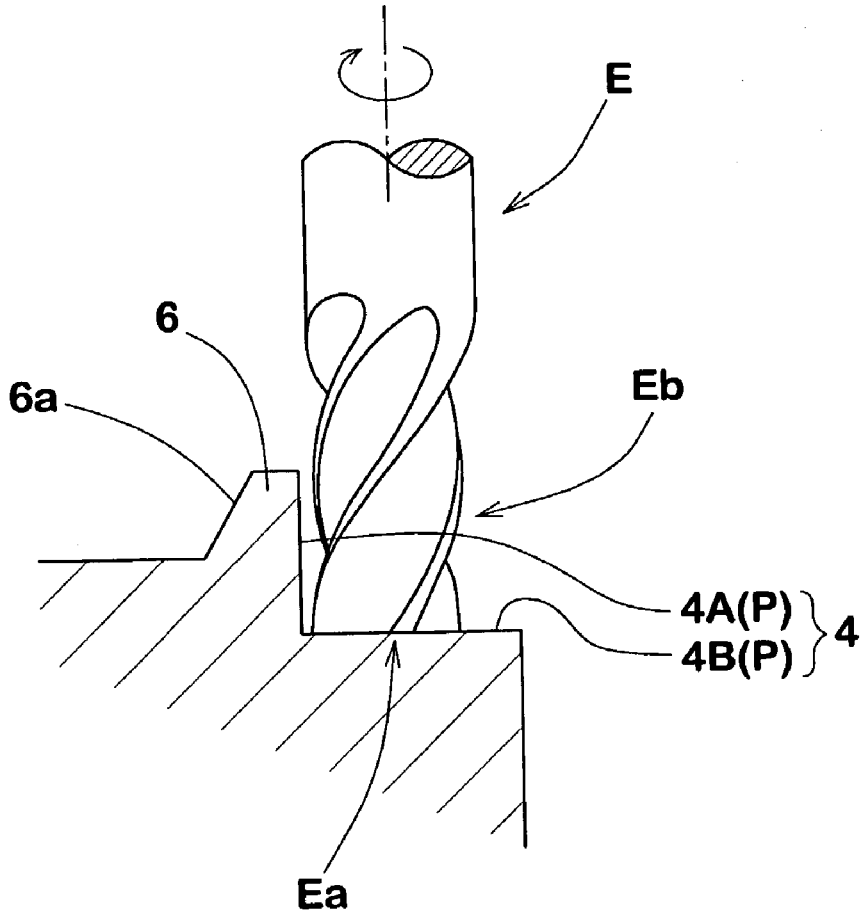
FIG. 5 is a cross sectional view showing an example of a milling machine.

In this embodiment, using an end mill E as shown in FIG. 5, the back-support wall 4B is finished with the end Ea of the end mill head, and the side-support circumferential wall 4A is finished with the side face Eb of the end mill head. As to the face member 2, on the other hand, similarly the side face 2*a* is finished by end milling, and a peripherally part 2*be* of the back face 2*b* is finished by end milling or face milling. In this embodiment, both of the face member 2 and main body 3 are made by casting. Therefore, the joint surface of the face member 2 (namely, the side face 2*a* and a part of the back face 2*b*) and the joint surface of the main body 3 (namely, the walls 4A and 4B) which are originally cast surfaces are machine finished to improve the accuracy.

The contour of the face member 2 defined by its side face 2*a* and the contour defined by the side-support circumferential wall 4A are formed in the substantially same size OR in order to further increase the locking force by press fitting, the side-support circumferential wall 4A is made relatively 0.1 to 0.5 mm smaller than the face member 2.

The portion to be machine finished is formed to have a cutting stock or a margin of 0.5 to 2.0 mm, preferably 0.5 to 1.0 mm.

Figure 6:
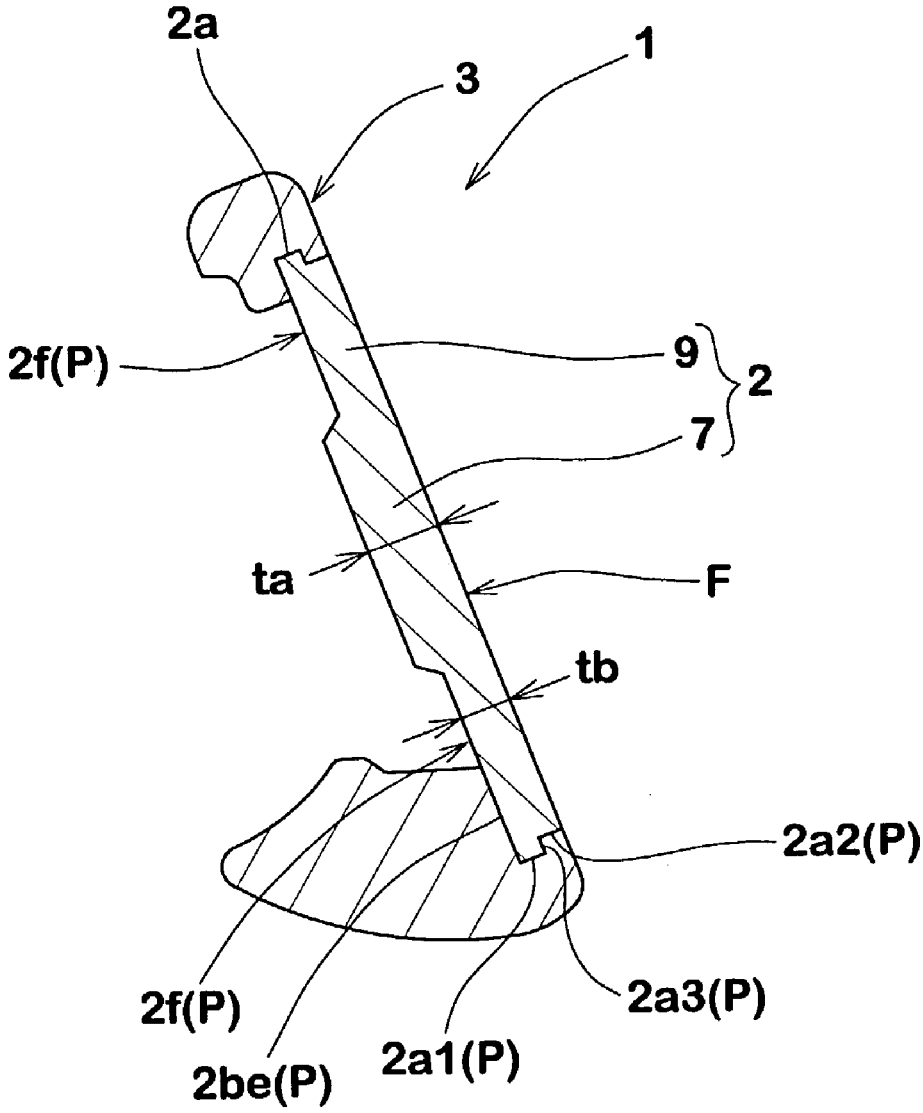
FIG. 6 is a cross sectional view showing a modification of the face member shown in FIG. 2.

FIG. 6 shows a modification of the above-mentioned face member 2, wherein a central part 7 (thickness ta) is formed to be thicker than the peripheral part 9 (thickness tb) to improve the durability of the club face portion.

The thickness (tb) of the thin peripheral part 9 is set in a range of from 1.5 to 3.5 mm, preferably 1.5 to 2.5 mm to improve the rebound performance of the face portion while maintaining the durability.

As with the former example, the face member 2 is a cast article and each face 2*a*1, 2*a*2 and 2*a*3 of the side face 2*a* is a machined surface (P).

Further, the back face 2*b* of the face member 2 is a machined surface (P) in at least the back face 2*f* of the thin peripheral part 9 including the part 2*be*.

The area of the machined surface (P) in the back face 2*b* is preferably in a range of not less than 50%, more preferably not less than 70%, still more preferably 100% of the area of the front face (F) in view of the accuracy in thickness and minimizing the thickness in the thin part. For the same reason, it is also preferable that the front face (F) is finished using the NC machine tool and the area of the machined surface is preferably in a range of not less than 50%, more preferably not less than 70%, still more preferably 100% of the area of the front face (F).

Comparison Test

The face member was made of a titanium alloy Ti-6Al-4V by precision casting. The main body was made of a stainless steel SUS630 by precision casting. In order to evaluate the strength of the junction, a hitting test was conducted as follow. The club head was attached to a shaft to make an iron club, and the club was mounted on a swing robot. The club head struck two-piece golf balls 3000 times at the head speed of 45 meter/second, and thereafter the club face portion including the junction was checked for deformation and/or damage. The test results are shown in Table 1.

member 2 welded to the main body 3 so as to close the opening (O). Thus, in this embodiment, the above-mentioned junction is a welded joint B.

Figure 9:
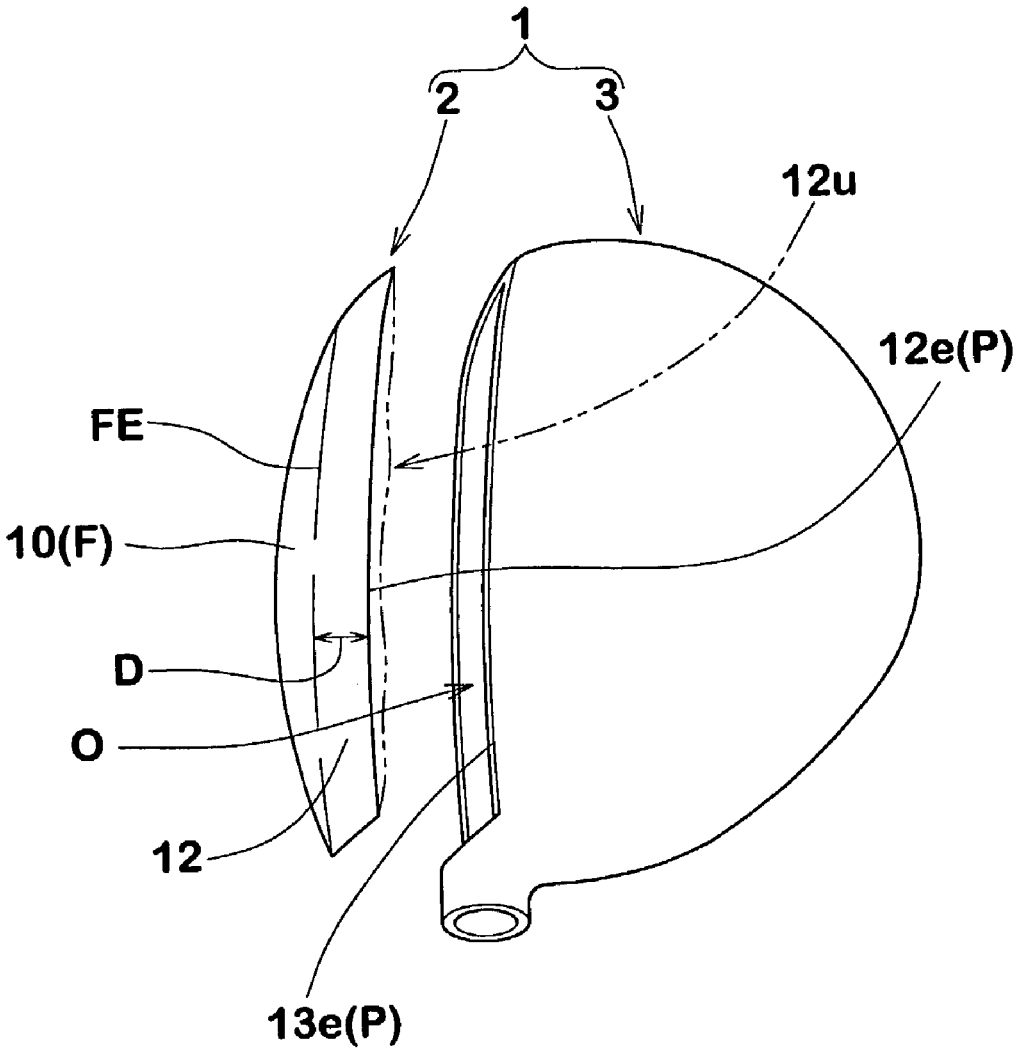
FIG. 9 is an exploded perspective view of the wood-type golf club head.

As shown in FIG. 9, the face member 2 comprises a main part 10 defining the club face F, and an extension 12 extending backward from the edge FE of the club face F and having a width D of from 7 to 30 mm along the surface. The backward extension 12 is formed continuously around the main part 10 which forms the entirety of the club face F.

Figure 8:
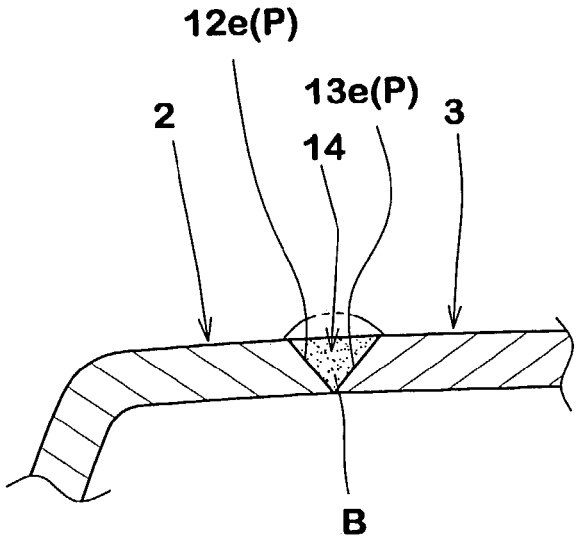
FIG. 8 is a cross sectional view of the front part of the club head crown taken along a line B—B in FIG. 7, showing a junction between the face member and the main body.

In this embodiment, the hollow main body 3 is made by casting a metal material such as titanium alloys. And the face member 2 is made by forging a metal material such as titanium alloys. As shown in FIG. 8 and FIG. 9, the rear edge of the backward extension 12 is machined to remove unwanted part 12*u*, and the edge of the opening (O) is also machined so that the machined surface 12*e* of the backward extension 12 and the machined surface 13*e* of the main body 3 form a V-shaped groove 14 which is filled with the weld metal B. And they are butt welded.

Figure 10:
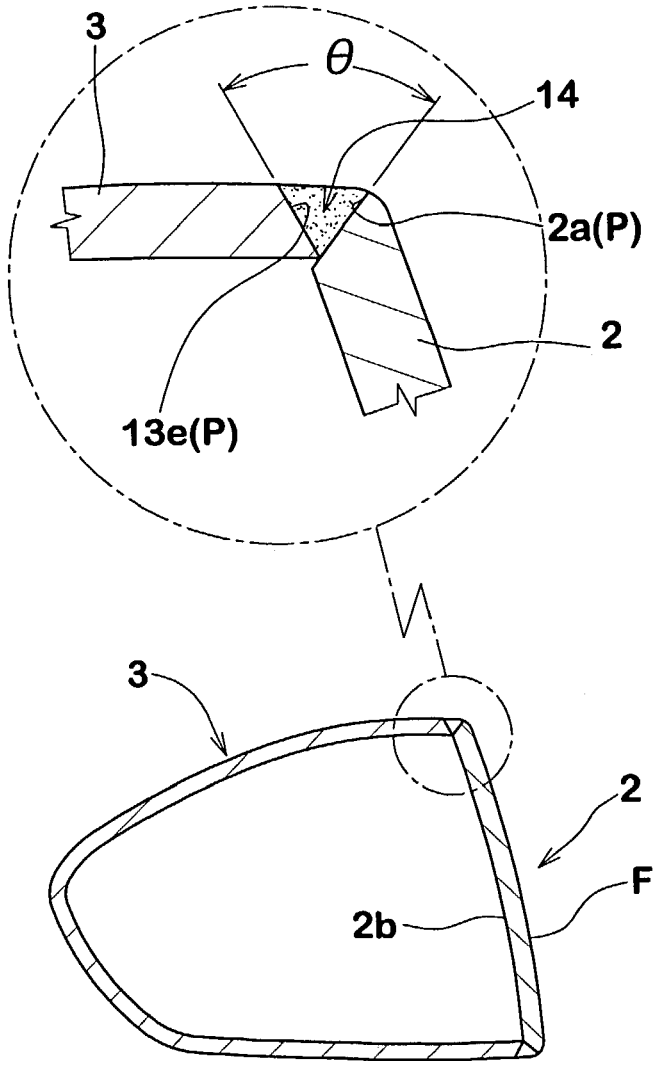
FIG. 10 is a cross sectional view of a wood-type golf club head according to the present invention.

FIG. 10 shows another example of wood-type golf club head 1 according to the present invention.

Figure 11:
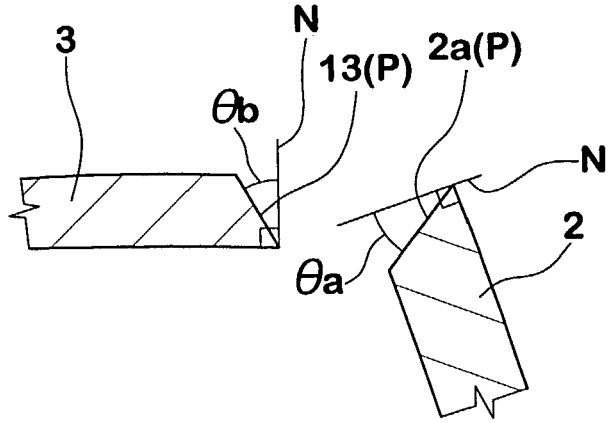
FIG. 11 is a cross sectional view showing the machined joint surfaces of the face member and main body thereof.

In this embodiment, the face member 2 is not provided with the above-mentioned backward extension 12. Thus, the face member 2 is an almost flat or slightly curved metal plate. The face member 2 is made by forging a metal plate, and the edge thereof is machined such that the side face 2*a* tapers from the front face (F) to the back face 2*b* at an angle of θa as shown in FIGS. 10 and 11. Thus, the side face 2*a* of the face member 2 is the machined surface (P).

The main body 3 is hollow and it has an opening (O) on the front thereof. The main body 3 is made by forging a metal plate, and the edge of the opening is machined such that the surface 13*e* of the edge inclines backwards at an angle of θb as shown in FIGS. 10 and 11.

TABLE 1

| Iron type head | Ref. | Ex.1 | Ex.2 | Ex.3 | Ex.4 | Ex.5 | Ex.6 | Ex.7 |
|---|---|---|---|---|---|---|---|---|
| Face member | FIG. 2 | FIG. 2 | FIG. 2 | FIG. 2 | FIG. 6 | FIG. 6 | FIG. 2 | FIG. 2 |
| Making method | casting | casting | casting | casting | casting | casting | casting | casting |
| Finishing | sand blasting | sand blasting | machine | machine | machine | machine | machine | machine |
| Machined face | | | 2a1 & 2be | 2a1 & 2be | 2a1 & 2be | 2a1 & 2be | 2a1 & 2be | 2a1 & 2be |
| Thickness (mm) | | | | | | | | |
| Central portion | 2 | 2 | 2 | 2 | 3 | 3 | 2 | 2 |
| Peripheral portion | 2 | 2 | 2 | 2 | 2 | 2 | 2 | 2 |
| Main body | FIG. 3 | FIG. 3 | FIG. 3 | FIG. 3 | FIG. 3 | FIG. 3 | FIG. 3 | FIG. 3 |
| Making method | casting | casting | casting | casting | casting | casting | casting | casting |
| Finishing | sand blasting | machine | sand blasting | machine | machine | machine | machine | machine |
| Machined face | | 4A & 4B | | 4A & 4B | 4A & 4B | 4A & 4B | 4A & 4B | 4A & 4B |
| Locking part (4A2) | | | | | | | | |
| Thickness t1 (mm) | 1.5 | 1.5 | 1.5 | 1.5 | 1.5 | 1 | 1 | 0.3 |
| Height w1 (mm) | 1 | 1 | 1 | 1 | 1 | 0.7 | 0.7 | 0.3 |
| Hitting test | Face member came off | OK | Joint gap was caused | OK | OK | OK | OK | Joint gap was caused |

Wood-type Golf Club Head

Figure 7:
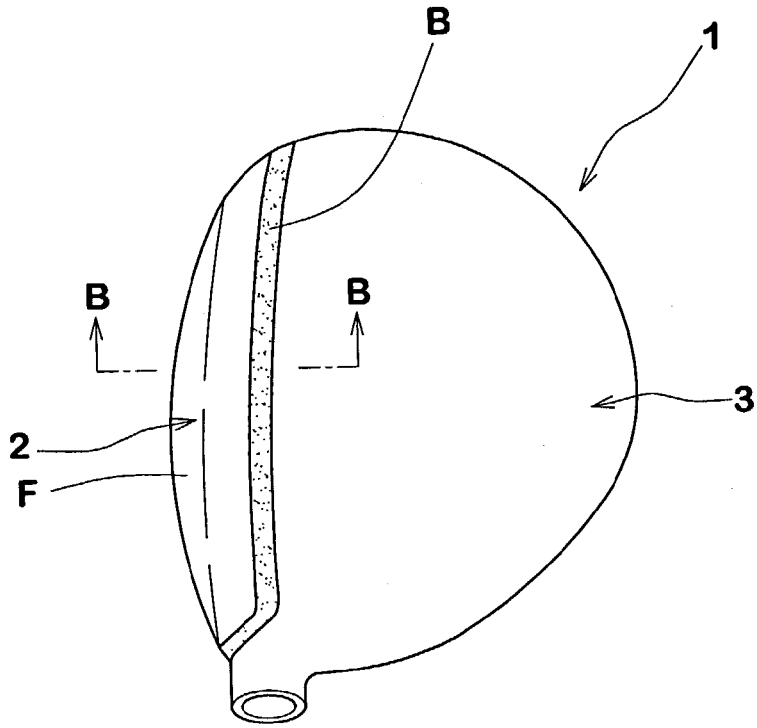
FIG. 7 is a top view of a wood-type golf club head according to the present invention.

FIG. 7 shows a wood-type club head according to the present invention.

This wood-type club head 1 comprises a hollow main body 3 having an opening (O) on the front thereof, and a face The side face 2*a* of the face member 2 and the surface 13*e* of the main body 3 are the machined surface (P). They are confronted to form a V-shaped groove 14 and are butt welded. The angle θ of the groove 14 is set in a range of from 30 to 120 degrees, preferably 30 to 100 degrees, more preferably 45 to 90 degrees. The angles θa and θb are preferably set in a range of from 15 to 60 degrees with respect to the respective thickness direction N.

FIGS. 12, 13, 14 and 15 show a still another example of wood-type golf club head 1.

In this embodiment, the face member 2 is an almost flat or slightly curved metal plate.

Figure 15:
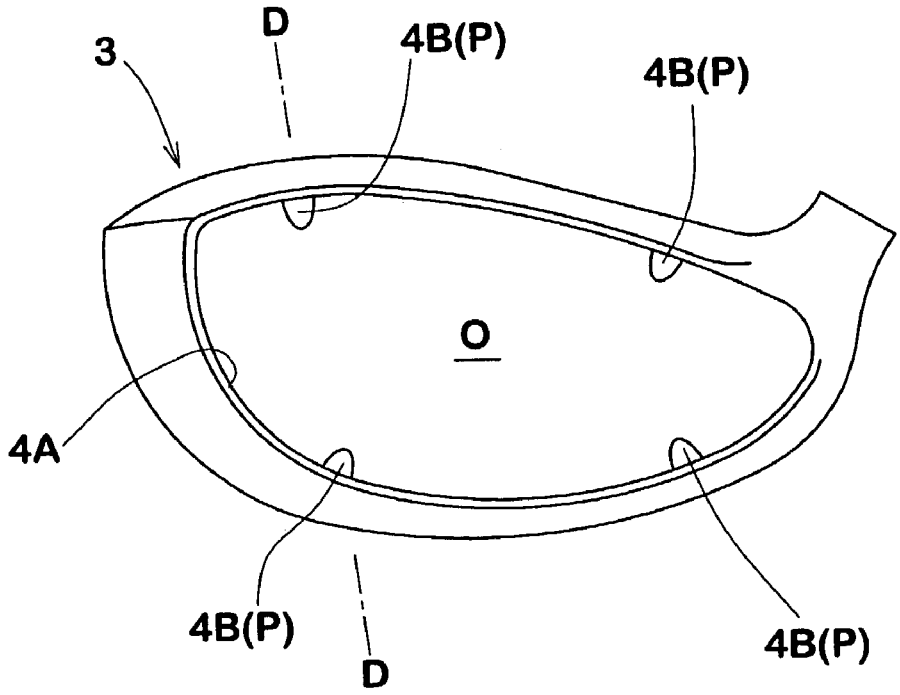
FIG. 15 is a front view of the main body of the wood-type golf club head shown in FIG. 12.

The main body 3 has an opening (O) on the front thereof as shown in FIG. 15, and a back-support wall 4B is provided along the circumferential edge of the opening (O) to protrude into the opening (O) and to support the periphery part 2*be* of the back face 2*b* of the face member 2. The back-support wall 4B can be formed continuously along the edge of the opening (O), but in this example, it is formed discontinuously so that each wall 4B has a V or U-shape when viewed from the front.

The face member 2 is made by dies cutting a rolled metal plate, such as titanium alloy plate. The main body 3 is made by casting a metal material such as titanium alloys.

Comparison Test

Wood-type club heads of the substantially same outer shape were made according to the specifications shown in Table 2, wherein the face member and main body were made of a titanium alloy Ti-6Al-4V, and they were welded. The designed targeted value for the loft angle was 10 degrees. The real loft angle of each of the club head was measured. The results are shown in Table 2.

In order to evaluate the strength of the weld joint, a hitting test was conducted as follows. The club head was attached to a shaft to make an wood club (ten samples per each), and the club was mounted on a swing robot. The club head struck two-piece golf balls 3000 times at the head speed of 50 meter/second, and thereafter the junction was checked for damage. The test results are shown in Table 2, wherein the number of the club heads which had acceptable small damage or no damage is shown. As the sample number was ten, the number ten means the best.

TABLE 2

Figure 12:
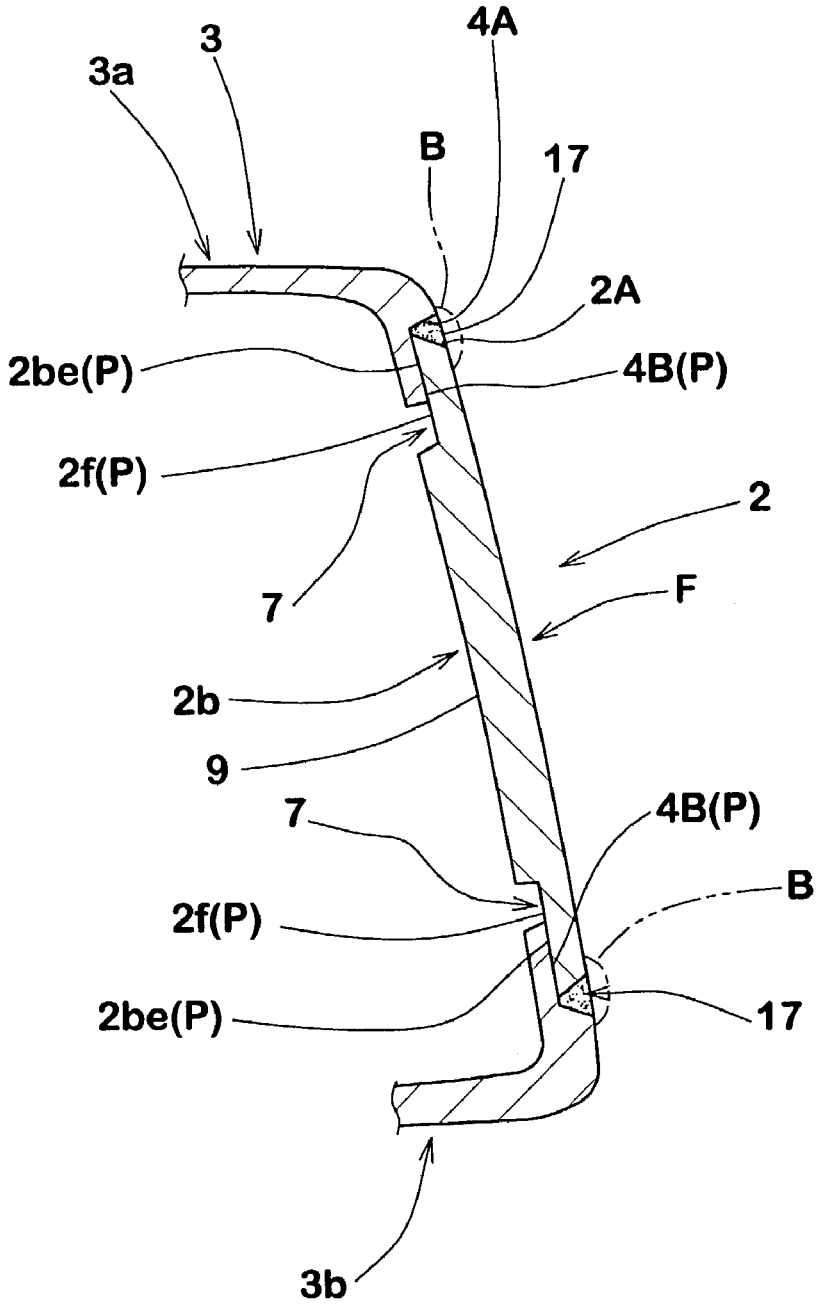
FIG. 12 is a partial cross sectional view of a wood-type golf club head according to the present invention.

| Wood type head | Ex.1 | Ref.1 | Ex.2 | Ref.2 | Ex.3 | Ref.3 |
|---|---|---|---|---|---|---|
| Structure | FIG. 7 | FIG. 7 | FIG. 10 | FIG. 10 | FIG. 12 | FIG. 12 |
| Face member | | | | | | |
| Making method | casting | casting | casting | casting | dies cutting rolled plate | dies cutting rolled plate |
| Finishing | machine | sand blasting | machine | sand blasting | machine | as it is |
| Machined face | 12e | | 2a | | 2be | |
| Main body | | | | | | |
| Making method | forging | forging | forging | forging | casting | casting |
| Finishing | | | | | machine | sand blasting |
| Machined face | | | | | 4B | |
| Real loft angle (deg.) | | | | | | |
| Average | 10.2 | 10.5 | 10.3 | 10.7 | 10.1 | 10.6 |
| Maximum | 10.9 | 11.5 | 11 | 11.9 | 10.5 | 11.8 |
| Minimum | 9.6 | 9.3 | 9.5 | 9.3 | 9.6 | 9.5 |
| Dispersion (σ) | 0.6 | 1 | 0.7 | 1.2 | 0.5 | 1.1 |
| Hitting test | 10 | 9 | 10 | 7 | 10 | 9 |

As the back-support wall 4B and the periphery part 2*be* come into contact with each other, they are the machined surface (P).

In order to form a v-shaped groove 17 for welding metal B annularly between the circumferential wall 4A of the main body 3 and the circumferential side face 2A of the face member 2, the circumferential side face 2A is machined to taper from the back face 2*b* to the front face (F). Preferably, the circumferential wall 4A is also machined to taper reversely as shown in FIG. 12.

Figure 13:
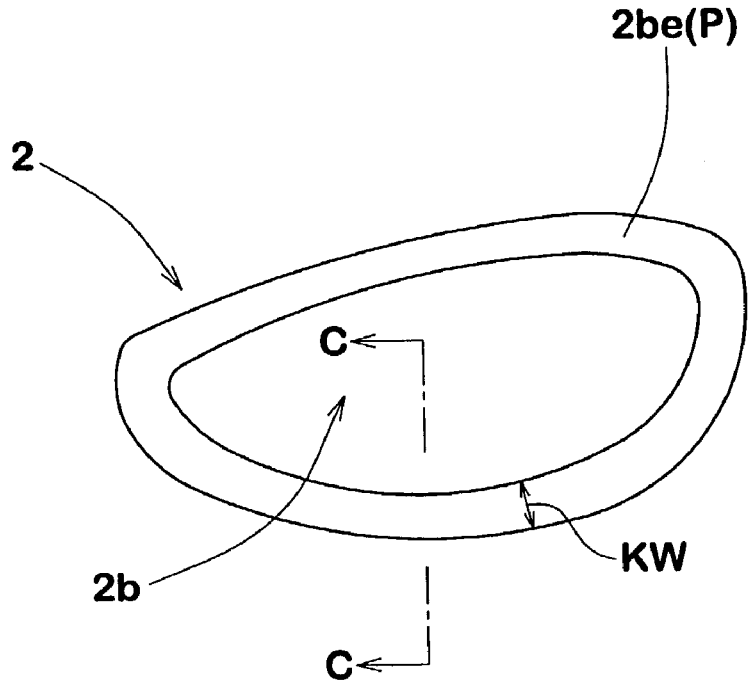
FIG. 13 is a back view of the face member thereof.
Figure 14:
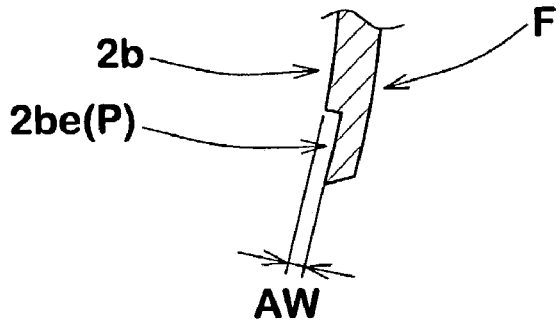
FIG. 14 is a partial cross sectional view of thereof.

As shown in FIGS. 13 and 14, the machined periphery part 2*be* of the face member 2 extends continuously along the circumferential edge of the face member 2 to have a certain width KW and also to have a certain depth AW so that a central portion surrounded by the machined periphery part 2*be* is protrude from the periphery part 2*be* and thus the central portion is thicker than the periphery part. Preferably, the width KW of the machined periphery part 2*be* is such that a thin part 7 is left between the thick central portion 9 and the back-support wall 4B, and the thin part 7 extends continuously around the thick central portion 9 to improve the rebound performance.

From the test results, it was confirmed that the loft angle variation and durability can be improved.

The present invention can be applied to various golf club heads such as utility-type and patter-type aside from iron-type and wood-type.

Incidentally, if the joint surface is made with accuracy by, for example, hot forging using dies, it will be not necessary to finish it using a machine tool.

The invention claimed is:

1. A golf club head comprising:

a face member forming at least a part of the golf club face for hitting a ball, said face member having a joint surface, and a main body having a joint surface, said joint surface of the face member and said joint surface of the main body being attached to each other to form a junction, at least one of the joint surface of the face member and the joint surface of the main body being a machined joint surface, wherein the face member has a front face, a back face and a side face, said side face having a step configuration;

the main body has an opening forming a mounting surface for the face member, wherein the mounting surface includes a side-support circumferential wall contacting and supporting the stepped side face of the face member, and a back-support wall extending into the opening from the side support circumferential wall and contacting and supporting the back face of the face member, and said at least one joint surface that is machined includes said side-support circumferential wall and the back support wall of the main body and said side face and a peripheral part of the back face of the face member, and the contour defined by the side-support circumferential wall is slightly smaller than the contour of the face member defined by the side face, and the side-support circumferential wall and the side face are jointed to each other by press fitting.

2. The golf club head according to claim 1, wherein the face member and main body are each made by casting.

3. A golf club head comprising a main body provided with a face plate mount comprising a side-support wall and a back-support wall, and a face plate having a front face, a back face and a side face and mounted on said face plate mount so that to at least a part of the golf club face for hitting a ball is formed by the front face, wherein the side face and the side-support wall are machined such that the contour of the face plate mount defined by the side-support wall becomes 0.1 to 0.5 mm smaller than the contour of the face plate defined by the side face, and the side face and the side-support wall are jointed to each other by press fitting, and a periphery of said back face and the back-support wall are machined to fit each other and jointed to each other.

4. The golf club head according to claim 3, wherein the main body is a cast article of a metal material.

5. The golf club head according to claim 3, wherein the face plate is a cast article of a metal material.

6. The golf club head according to claim 3, wherein the face plate is a forged article of a metal material.

7. The golf club head according to claim 3, wherein the main body is a cast article of a metal material, and the face plate is a cast article of a metal material.

8. The golf club head according to claim 3, wherein the main body is a cast article of a metal material, and the face plate is a forged article of a metal material.

9. The golf club head according to claim 3, wherein the face plate mount further comprises a front-support part which, by its plastic deformation, secures the face plate between the front-support part and said back-support wall.

* * * * *